United States Patent [19]

Schmidt et al.

[11] 3,975,938

[45] Aug. 24, 1976

[54] ROLL CHANGING DEVICE FOR ROLLING MILLS OR THE LIKE

[75] Inventors: Arno Schmidt, Kreuztal-Ferndorf; Rudolf Mueller, Hilchenbach-Allenbach, both of Germany

[73] Assignee: Schloemann-Siemag Aktiengesellschaft, Germany

[22] Filed: Dec. 5, 1975

[21] Appl. No.: 638,129

[30] Foreign Application Priority Data

Dec. 21, 1974 Germany ..... 2461005

[52] U.S. Cl. ..... 72/239

[51] Int. Cl.[2] ..... B21B 31/08

[58] Field of Search ..... 72/238, 239

[56] References Cited

UNITED STATES PATENTS 3,491,570 1/1970 Beard ..... 72/239

3,842,639 10/1974 Petros ..... 72/239

*Primary Examiner*—Milton S. Mehr

*Attorney, Agent, or Firm*—Daniel Patch; Henry C. Westin

[57] ABSTRACT

The disclosure concerns a roll changing device for roll stands of a rolling mill or the like having a pair of working rolls and backing rolls assigned to each working roll in which the roll pairs, including their component bearing parts, can be moved as separate units into and out of the windows of the housings of the mill. A piston cylinder assembly provided for this purpose is arranged in front of the understructure for the support member of the lower backing roll.

7 Claims, 4 Drawing Figures

Fig. 1
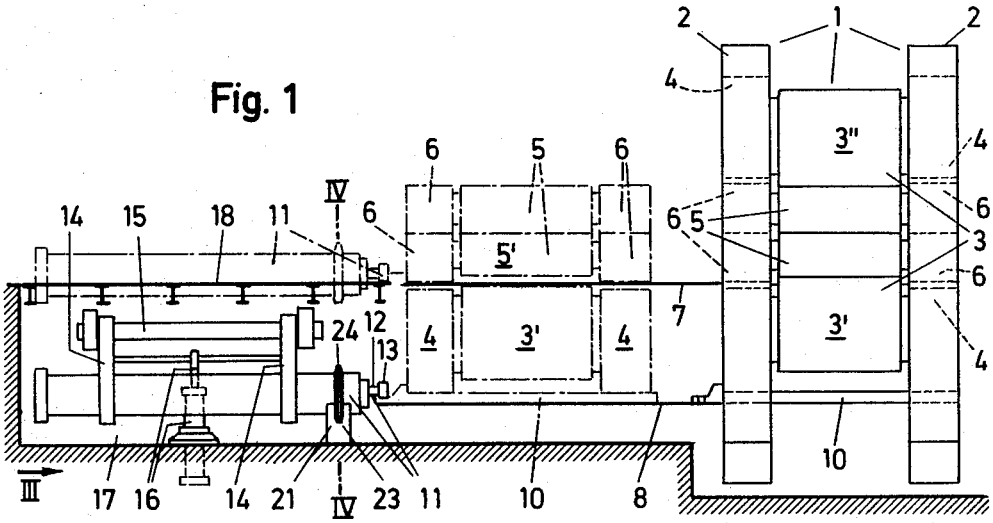
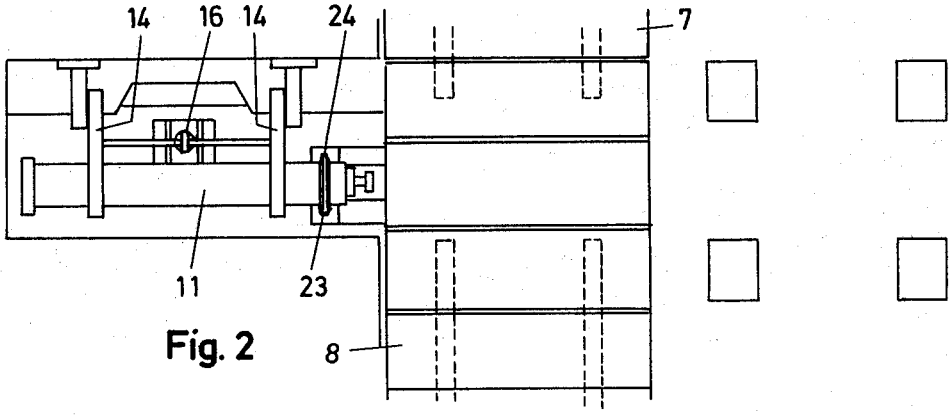
Fig. 2
Fig. 3
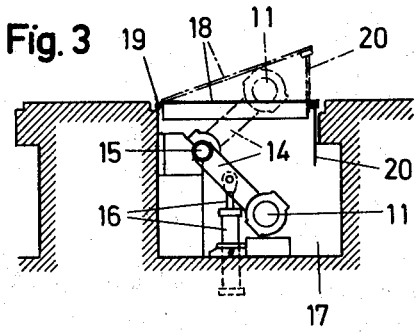
Fig. 4
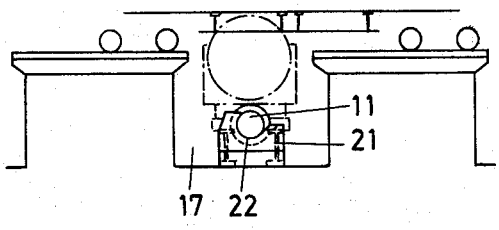

ROLL CHANGING DEVICE FOR ROLLING MILLS OR THE LIKE

In present-day practice when operating a rolling train with several four-high roll stands, as a rule it is necessary to exchange the working roll pairs of the first and the middle stands once during a shift, for example, during an eight-hour period. As far as the latter stands are concerned, it happens quite often that the pairs of working rolls have to be exchanged at least twice during a shift.

The backing rolls have to be changed only once a week as a rule. In order to allow for a changing of working roll pairs and the backing roll pairs, the windows of the mill housings of conventional stands are not only equipped with several tracks for supporting the pairs of working and backing rolls when moved into and out of the stand, but, also, there are provided separate roll changing devices for the pairs of working and backing rolls that operate independently of one another. This arrangement results in a considerable added expense for each individual roll stand of the rolling train.

It is the purpose of this invention to reduce such costs without adversely influencing the process of changing the rolls.

The invention has for its object a roll changing device for a rolling mill or the like in which the same machine or elements can be optionally employed for changing a pair of working rolls or for changing a pair of backing rolls.

According to the invention, an arrangement is provided, including a piston cylinder assembly or the like, for moving both roll pairs into and out of the stand in which the cylinder assembly is arranged to be adjustable to two working positions so that it is displaceable out of the area of the understructure for the lower backing roll, which defines one working position, to the upper level of the proper driving plane for the lower working roll, which is the second position.

The invention provides for suspending on swing levers the piston cylinder assembly for moving the roll pairs into and out of the stand and to provide that the elevation of the cylinder be adjustable around a stationary axis in which the adjustment is supplied by the aid of a second piston cylinder assembly.

According to another characteristic of the invention, it is desirable that the stationary axis of the swing levers being arranged midway between the lower and the upper positions of the driving piston cylinder assembly and that the angle of rotation of the swing levers be approximately 90 degrees. In this way the stationary axis of the swing levers can rest in a pit covered by a swingable lid which can be lifted with the aid of the swing levers when the driving piston cylinder assembly moves upward and which holds an apron underneath its edge facing the axis of rotation; thereby, covering the gap between the hoisted swingable lid and the edge of the pit. In this way, the pit is covered by the swinging lid and the roll changing device can be arranged in a very compact way close to the underneath side of the mill floor when the driving piston cylinder assembly is in its lowered position.

Since the driving piston cylinder assembly of the present invention is employed when in its lowered position to move the relatively heavy pairs of backing rolls, it is a further object of the invention that the piston cylinder assembly when in its lower working position be braced by a stationary counter bearing in both the pull and push directions.

Another object of the invention is to provide that the piston rod of the driving piston cylinder assembly be coupled with the understructure of the lower backing roll as well as with the component part of the lower working roll with the aid of a cloverleaf catch or a latch. A special adjusting device can be assigned to the slide catch or the latch, respectively, whereby the roll changing device can be coupled or uncoupled to and from one or the other pair of rolls with the aid of remote control.

These objects and advantages of the present invention will be better understood when the following description of one embodiment thereof is read along with the accompanying drawings of which:

FIG. 1 shows a side elevation and in diagrammatic form a four-high roll stand with a roll changing device constructed according to the present invention, FIG. 2 shows a plan view of the stand and device shown in FIG. 1, FIG. 3 shows a view of the roll changing device shown in FIG. 1 seen in the direction of the arrow III of FIG. 1, and FIG. 4 shows a section view taken along lines IV — IV of FIG. 1.

A roll stand 1 shown in FIG. 1 is equipped with the two commonly constructed roll housings 2. Backing roll pair 3, including bearing-chock component parts 4, on the one hand and working roll pair 5, including bearing-chock component parts 6, on the other hand are guided in the windows of the roll housings. The backing roll pair 3 as well as the working roll pair 5 can be moved in and out of the roll housings in order to effect a roll changing of the rolls. It is provided that both rolls of the working roll set 5 together with their component parts 6 can be supported on a track system 7 when moving into and out of the stand. The working roll pair in its extracted position is shown in dot-and-dash lines in FIG. 1.

As shown in FIG. 1 the lower roll 3' of the backing roll pair with its component parts 4 rests on an understructure 10. This understructure can be displaced in a longitudinal direction over a track system 8. For moving out of the stand, the lower roll 3' together with the upper roll 3'', which at this time is supported on the component parts of the lower roll with the aid of a roll chair or stool, not shown in the drawing, is carried on the understructure 10 in a longitudinal direction over the track system 8.

For the reason of limited space the lower backing roll 3' only is shown in its extracted position in dot-and-dash lines in FIG. 1. A piston cylinder assembly 11 is provided for driving the backing roll pair 3 into and out of the stand 1; the piston rod 12 of which is coupled with the understructure 10 with the aid of a cloverleaf slide catch or a latch 13 to effect the displacement of the understructure 10 in the longitudinal direction over the track system 8.

The same extracting and reinserting piston cylinder assembly 11 is also used for extracting and reinserting the working roll pair 5 together with its component parts 6. In order to make this possible, the extracting and reinserting piston cylinder assembly 11 is elevationally arranged adjustable to a second working position, in which it is displaceable out of the area of the understructure 10 for the lower backing roll 3' upwards to the level of the track system 7 for the component parts 6 of the lower working roll 5' as indicated in FIG. 1 with the aid of dot-dash lines. In order to make this height adjustment possible, the piston cylinder assembly 11 is suspended on a pair of swing levers 14 which are mounted adjustable around a stationary axis 15 with the aid of an adjusting piston cylinder assembly 16. As shown in FIG. 3 in both working positions, the piston cylinder assembly 11 is maintained substantially coaxial with the vertical center of the window of the housing 2.

The stationary axis 15 of the swing levers 14 lies midway between the lower and the upper working positions of the piston cylinder assembly 11 and the angle of rotation of the swivel arms 14 is approximately 90° as can be best seen in FIG. 3. This figure also illustrates that the stationary axis 15 of the swing levers 14 is supported in a pit 17 which is covered by a swingable lid 18. The swingable lid 18 is movably supported around an axis 19 which is in parallel alignment with the axis 15. In the lower position of the piston cylinder assembly 11, the lid 18 is braced on the adjacent edge of the pit 17 opposite the axis 19. When the piston cylinder assembly 11 is lifted out of its lower position, it pushes the swingable lid 18 up during the last part of its path of rotation to the position shown in the dot-and-dash lines in FIG. 3. An apron 20 suspended from the bottom of the swingable lid 18 on the edge opposite the axis of rotation 19 covers the gap which would normally occur between the lifted swingable lid 18 and the edge of the pit 17.

As can be seen in FIGS. 1, 2 and 4, the piston cylinder assembly 11 engages a stationary counter bearing 21 in its lower position. This counter bearing connects the piston cylinder assembly 11 in both the pull and push directions to the foundation and relieves the swing levers 14 of the forces which occur when the backing rolls 3 are being driven into and out of the stand 1. The counter bearing 21 is constructed with a groove 22, shown in FIG. 4, corresponding with the outside diameter of the piston cylinder assembly 11 into which the cylinder assembly 11 embeds itself with approximately half of its circumference. This is accomplished by forming on the adjacent end of the piston cylinder assembly 11 a circular flange 24 which engages a keyseat 23 that forms part of the groove 22.

It should also be mentioned that the upper track system 7 provided for carrying the working roll set 5 into and out of the stand 1 is arranged on one side of the driving piston cylinder assembly 11 and the lower track system 8 provided for carrying the backing roll set 3 is arranged on the opposite side thereof as it can be seen best in FIG. 2. The track systems 7 and 8 are part of a side shifting arrangement well known in the art that alternately allows them to be brought in first to stand 1. This guarantees that the working and the backing rolls can be brought to the stand and moved away from it without any hindrance by the other roll set.

In accordance with the provisions of the patent statutes, we have explained the principle and operation of our invention and have illustrated and described what we consider to represent the best embodiment thereof.

We claim:

1. In a rolling mill or the like having a housing, a pair of working rolls, a pair of backing rolls for each working roll, said rolls being arranged to form a 4-high vertical rolling mill roll arrangement, a window in said housing for receiving said rolls in a manner that the work roll as a set of rolls and the backing rolls as a set of rolls can be inserted into and removed from said window, said insertion and removal of said roll sets being performed at different elevational positions with respect to said window, a piston cylinder assembly arranged on one side of said housing for independently moving said roll sets into and from said housing, and means for adjusting said piston cylinder assembly to bring said piston cylinder assembly into a first working position corresponding to one of said elevational positions to effect said movement of said work roll set and into a second working position corresponding to said other elevational position to effect said movement of said backup roll set.

2. In a rolling mill according to claim 1, means for engaging said piston cylinder assembly when in its second working position in a manner to resist the tendency of the said cylinder to move in the direction of its axis during its working stroke.

3. In a rolling mill according to claim 1, including means secured to said piston cylinder assembly for operatively and selectively engaging and disengaging said piston cylinder assembly with said sets of rolls.

4. In a rolling mill according to claim 1 wherein said means for adjusting said piston cylinder assembly comprises:

a rocker lever system means for securing said piston cylinder assembly to said rocker lever system, and other means connected to said rock lever system for displacing said piston cylinder assembly into its said two working positions.

5. In a rolling mill according to claim 4 wherein:

said rocker lever system includes means for mounting said piston cylinder assembly substantially within the vertical center of said window in both of its working positions.

6. In a rolling mill according to claim 4 wherein said rocking lever system includes a fixed shaft, means for supporting said shaft so as to position the shaft midway between said two working positions of said piston cylinder assembly and wherein said other means is constructed and arranged to impart approximately 90° movement to said piston cylinder assembly between said two working positions thereof.

7. In a rolling mill according to claim 6 wherein said fixed shaft is arranged in a pit having an open top, a cover constructed and arranged to cover the top of said pit, means for pivotally supporting said cover so that it can be raised above the top of said pit when said piston cylinder assembly is in its first working position and lowered to cover said pit when said piston cylinder assembly is in its second working position, and an apron provided on the side of said cover furthest away from its point of pivot for closing off access to said pit from the side adjacent said apron.

* * * * *